US005779240A

United States Patent [19]

Santella

[11] Patent Number: 5,779,240

[45] Date of Patent: Jul. 14, 1998

[54] WATER FORTRESS

[76] Inventor: Andrew W. Santella, 81 Mercer St., Hamilton, N.J. 08690

[21] Appl. No.: 879,585

[22] Filed: Jun. 20, 1997

[51] Int. Cl.[6] ..... A63F 9/02

[52] U.S. Cl. ..... 273/349

[58] Field of Search ..... 273/349

[56] References Cited

U.S. PATENT DOCUMENTS

| | | | |
|---|---|---|---|
| D. 181,565 | 11/1957 | Wallace et al. | D34/15 |
| D. 245,640 | 8/1977 | Powell, Jr. | D34/15 LL |
| D. 272,168 | 1/1984 | Sielaff | D21/114 |
| D. 334,044 | 3/1993 | Lopatin | D21/240 |
| D. 358,620 | 5/1995 | Hill et al. | D21/114 |
| 2,148,438 | 2/1939 | Crain et al. | 273/102.1 |
| 2,752,156 | 12/1956 | Washburn | 273/349 |
| 2,874,967 | 2/1959 | Thereau et al. | 273/384 |
| 2,940,466 | 6/1960 | Speights | 137/356 |
| 3,539,181 | 11/1970 | Larsen | 272/56.5 |
| 3,843,127 | 10/1974 | Lack | 273/349 |
| 4,077,629 | 3/1978 | Chestney | 273/349 |
| 4,093,228 | 6/1978 | Pierce | 273/384 |
| 4,165,073 | 8/1979 | Kellerstrass | 273/349 |
| 4,243,220 | 1/1981 | Shelley | 273/1 R |
| 4,248,436 | 2/1981 | Corrigan | 273/349 |
| 4,257,460 | 3/1981 | Paranay et al. | 141/26 |
| 4,702,480 | 10/1987 | Popeski et al. | 273/384 |
| 5,480,336 | 1/1996 | Blanchard | 446/89 |
| 5,482,292 | 1/1996 | Stone | 273/384 |
| 5,586,767 | 12/1996 | Bohland | 273/349 |

*Primary Examiner*—William H. Grieb
*Attorney, Agent, or Firm*—Roberts & Mercanti, L.L.P.

[57] ABSTRACT

A water fortress used in a game or as a toy which has a hollow plastic frame connected to a garden hose. The water fortress receives a continuous supply of pressurized water from a garden hose. Access points along the plastic frame are used to supply the pressurized water to targets and water pistols. The front section of the frame has a canvas shield to protect the player within the water fortress from an opponent's water gun. The object of the game is for opposing players to shoot at the targets of the opposing player with the water pistols. When the targets are hit, they release pressurized water which sprays the opponent. The water fortress permits easy assembly/disassembly and multiple water fortresses may receive water from a singular garden hose at the same time.

20 Claims, 4 Drawing Sheets

WATER FORTRESS

BACKGROUND OF THE INVENTION

1. Field of the Invention

The present invention relates to a water fortress used in a game or as a toy. More particularly, the water fortress is comprised of a frame of hollow tubing which provides a continuous supply of water to water guns and targets through the hollow tubing. This allows players to engage in continuous game play without significant interruption.

2. Brief Description of the Prior Art

The art discloses water games or toys which dump water from a water reservoir when a target is hit. U.S. Pat. No. 4,702,480 (Popeski et al.) discloses a water dumping entertainment apparatus with a screened booth for a player. U.S. Pat. Nos. 4,093,228 (Pierce), 5,482,292 (Stone), and Des 334,044 (Lopatin) disclose various water dumping games and toys which use targets. Similarly, U.S. Pat. No. 2,874,967 (Thereau et al.) discloses a water target which sprinkles water when struck by a ball.

The art further discloses water toys having tubular parts which permit water flow. U.S. Pat. No. 3,539,181 (Larsen) discloses an outdoor gym set with water spray heads connected to a garden hose. U.S. Pat. No. 5,480,336 (Blanchard) discloses a water toy construction kit having tubular elements adapted for water flow through the elements. Likewise, U.S. Pat. No. 2,940,466 (Speights) discloses a combination enclosure fence and sprinkler system.

The art also discloses water guns directly attached to a continuous water supply. U.S. Pat. No. 4,257,460 (Paranay et al.) discloses a water gun attached to an expandable tube or bladder. U.S. Pat. No. 4,165,073 (Kellerstrass) discloses a game having two water guns attached to a garden hose "Y" connection. U.S. Pat. No. 3,843,127 (Lack) discloses a water toy having water guns and a target which emits water.

None of the above patents has a water fortress of the present invention which comprises a hollow frame structure that supplies a continuous water flow to targets and water guns.

SUMMARY OF THE INVENTION

The present invention addresses the shortcomings described above. In one aspect of the invention includes, a water fortress apparatus, comprising:

(a) a frame defining a space capable of retaining a player therein, the frame comprising hollow members which are capable of internal water flow, (b) a water connection in water communication with the hollow members, permitting pressurized water flow in and through the hollow members;

(c) a target mounted to the frame comprising means for releasing pressurized water from the frame when the target is activated;

(d) a water gun supply port capable of dispensing water from the hollow members; and, (e) a water gun detachably connected to the water gun supply port.

Another aspect of the invention includes a method for playing a water fortress game, comprising:

(a) providing a water fortress comprising a frame defining a space capable of retaining a player therein, the frame comprising hollow members which are capable of internal water flow; a water connection in water communication with the hollow members, permitting pressurized water flow in and through the hollow members; a target mounted to the frame comprising means for releasing pressurized water from the frame when the target is activated; a water gun supply port capable of dispensing water from the hollow members; and a water gun detachably connected to the water gun supply port; and, (b) spraying the target with water from a water gun.

DETAILED DESCRIPTION OF THE PREFERRED EMBODIMENTS OF THE INVENTION

The present invention comprises a water fortress to be used as a toy or in a game. The water fortress has a frame of plastic tubing and a barrier. The plastic tubing is connected to a water hose which provides a continuous pressurized water supply to the tubing. Access ports are located along the frame which allow target and water gun connections. The water fortress includes at least one target mounted to the frame, which when hit by an opponent player, releases water from a water reservoir or the plastic tubing of the frame onto another player located in the water fortress. The released water soaks the player within the water fortress. The target may then be reset to allow play to continue. Although a player would normally be a person, a player may be a trained animal or device.

Figure 1:
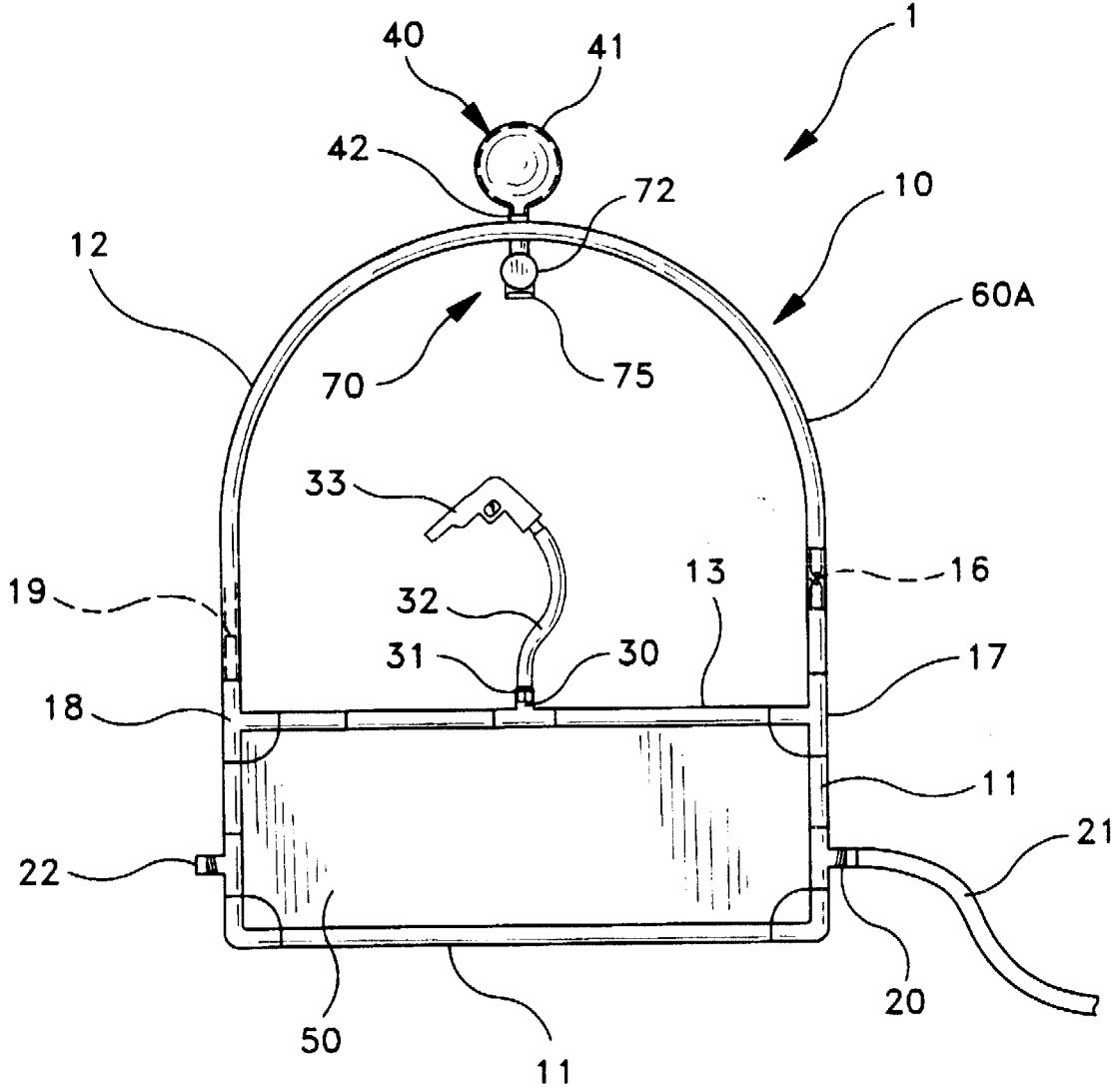
FIG. 1 is a front view of a preferred embodiment of the front section of the present invention.
Figure 3:
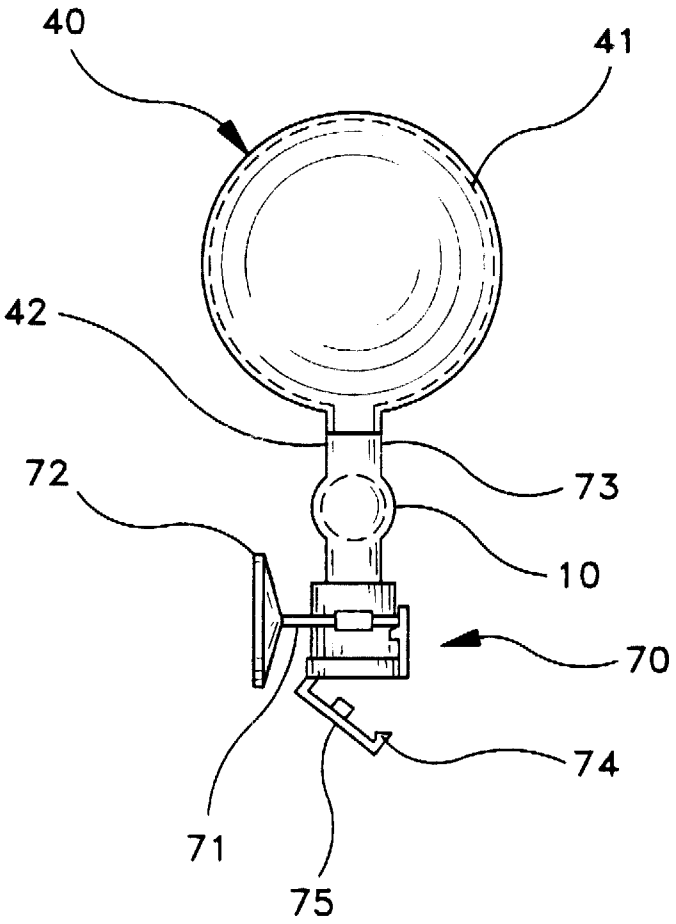
FIG. 3 is an exploded side view of the target assembly and water reservoir of FIGS. 1–2.
Figure 2:
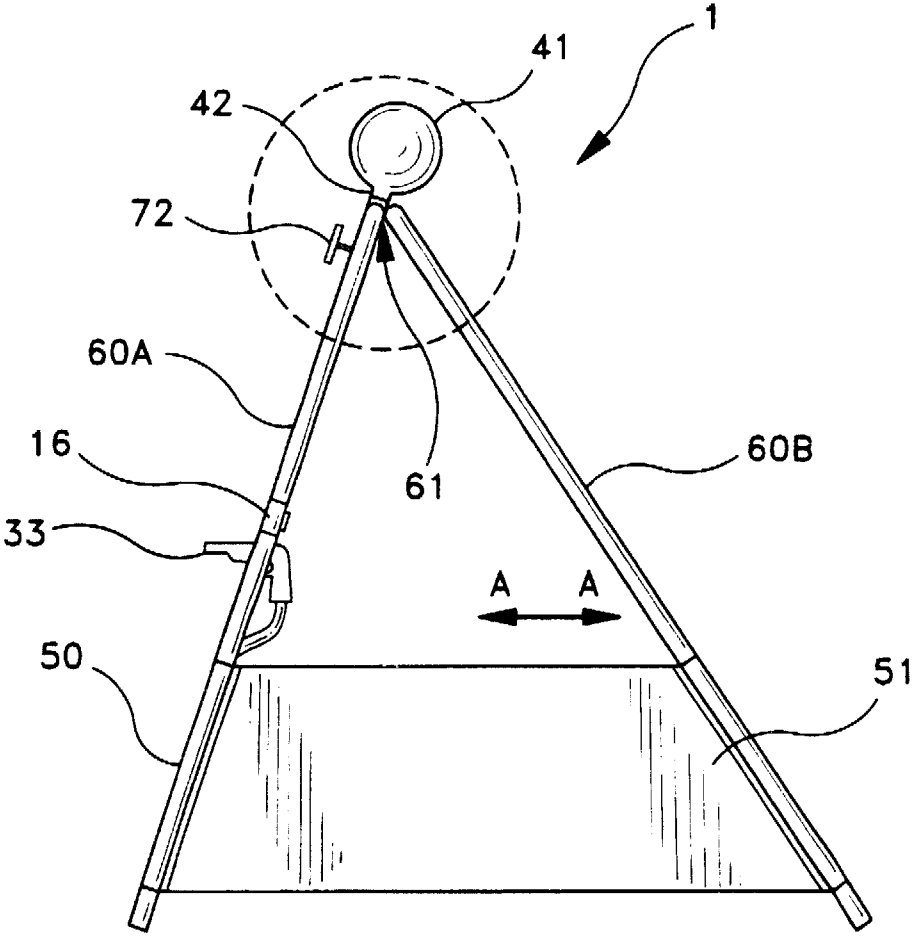
FIG. 2 is side view of the water fortress shown in FIG. 1.
Figure 4:
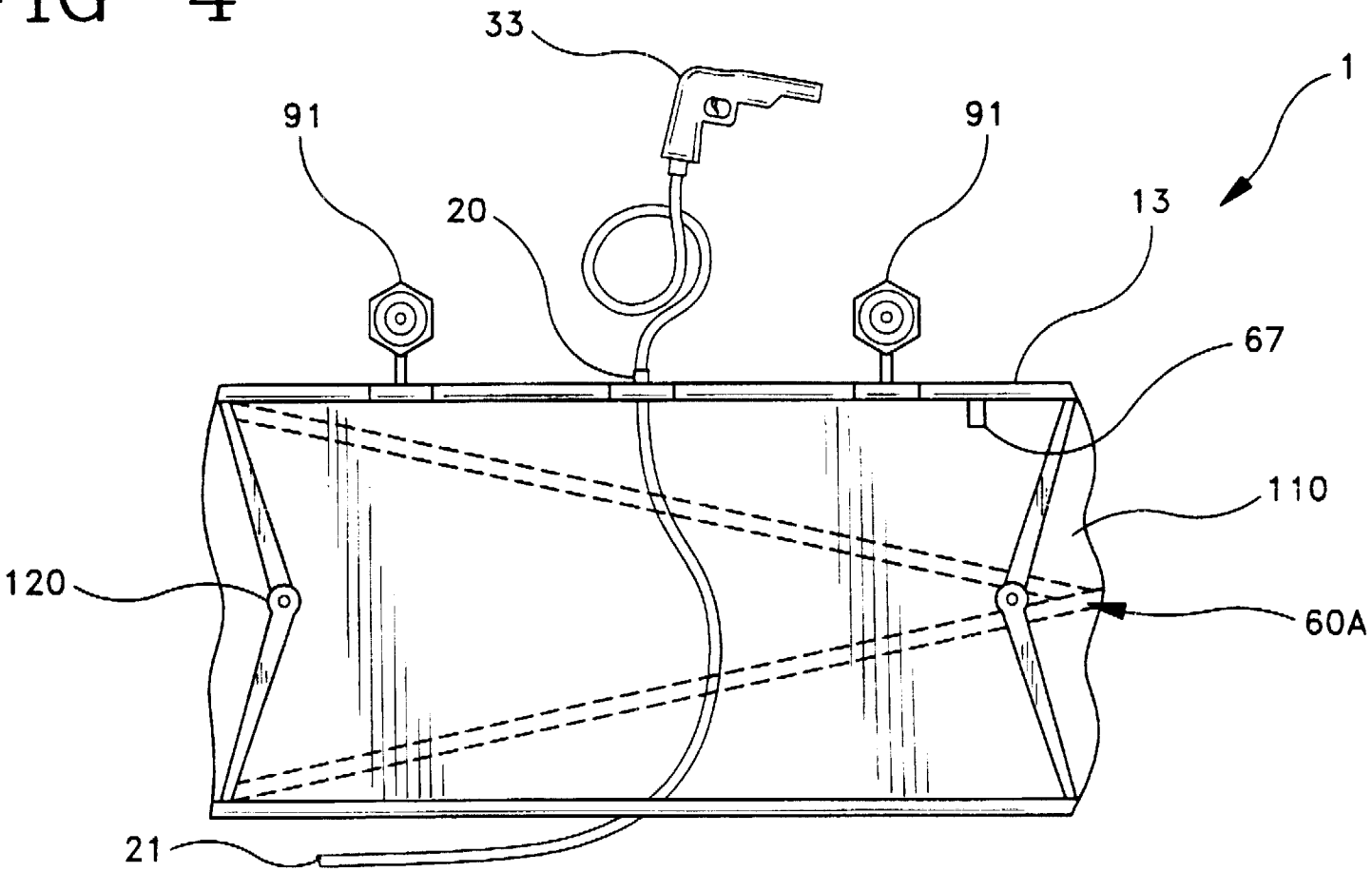
FIG. 4 is a front view of an alternative embodiment of the present invention showing a collapsible frame.

Those skilled in the art will readily appreciate the invention from the following discussion of the preferred embodiments when read in conjunction with the accompanying drawings of FIGS. 1–5B inclusive. One preferred embodiment of the present invention is illustrated in FIGS. 1 and 2. An enhanced view of the target assembly and water reservoir of FIGS. 1–2 is illustrated in FIG. 3. A second preferred embodiment of the present invention is illustrated in FIG. 4, with the target assembly of FIG. 4 further detailed in FIGS. 5A and 5B. Numeral designation of the parts in the drawings of FIGS. 1–5B are used to designate similar parts throughout the several views.

Referring to FIG. 1, a water fortress 1 has a frame 10, which includes a front section 60A. The front section 60A has a base support 11 connected to an arch support 12, further connected to a lateral support 13. The front section 60A is constructed of light-weight material having a hollow center which allows water passage therethrough. The light-weight material is preferably a plastic composition, such as polyvinyl chloride (PVC) or hardened rubber. The base support 11, arch support 12 and lateral support 13 are connected in such as way as to allow water flow in and through the front section 60A.

The base support 11 has a hose connection 20 which allows water to flow from an external pressurized water source, preferably a garden hose 21, into the front section 60A. The garden hose 21 may supply an individual water fortress or may have a multiple service configuration, such as a "Y" configuration, to supply two or more water fortresses at the same time. Additional hose connections 22 may be incorporated on the front section 60A to access additional garden hoses or other sources of water. Additionally, the additional hose connections 22 may connect to other water fortresses 1.

The lateral support 13 receives a continuous water supply from the garden hose 21 via the hose connection 20 and base support 11. Base support 11 communicates water to the lateral support 13 through "T" junctions 17 and 18. "T" junction 17 further permits water flow from base support 11 to the arch support 12. An interior plug 19 is located within the "T" junction 18, above the lateral support 13. This interior plug 19 obstructs any water flow from the base support 11 to the arch support 12 through the "T" junction 18. Being located above lateral support 13, the interior plug 19 does not interfere with water flow from the base support 11 to the lateral support 13 at the "T" junction 18.

The lateral support 13 has a supply port 30 which is connected to one end of a gun hose 32 using a water gun attachment 31. The second end of the gun hose 32 connects to a water gun 33. Pressurized water flows from the lateral support 13 to the water gun 33 through the supply port 30, water gun attachment 31 and gun hose 32. The gun hose 32 is designed for quick attachment to and release from either the water gun attachment 31 or water gun 33. The water gun attachment 31, gun hose 32 or lateral support 13 may further contain a manual or automatic shut-off valve (not shown) for water gun exchange and/or removal. Once the water gun 33 is disconnected, the supply port 30 may be configured as a water filling port for unconnected water guns.

The arch support 12 contains a push valve 16 located above the "T" junction 17 and between "T" junction 17 and the apex of the arch support 12. The push valve 16 cuts-off water flow to the arch support 12. This permits greater flexibility to the players for controlling water flow to the arch support 12. In the preferred embodiment, the push valve 16 remains closed during play. When the players want water to flow through the arch support 12, they switch the valve to an open position, allowing water flow past the push valve 16. If desired, the push valve 16 may be designed to remain open during play. Alternatively, the push valve 16 may be designed to require a continuous pressing by the players to remain either open or closed.

At the apex of the arch support 12, a target assembly 70 and water reservoir 40 are attached. The water reservoir 40 has a water containing ball 41 with an unobstructed water passage which permits water flow from the arch support 12 to fill the ball 41. The ball 41 may be made of a transparent or semi-transparent material allowing the players to measure the water level within the ball 41. Actual knowledge of the water level adds to anticipation in playing the game. A connection 42 attaches the ball 41 to a neck 73, which forms the water passage between the ball 41 and the frame 10. The connection 42 forms a water-proof seal and may be installed by hand without using tools. When a target 72 is activated, the ball 41 supplies water to a target assembly 70. The target assembly 70 contains the target 72 and a trap door 75 which are more fully described with reference to FIG. 3.

A barrier 50 may be placed between the lateral support 13 and the base support 11 at the base of front section 60A. Players remain obscured within the water fortress 1 while standing or knelling behind the barrier 50 during play, to protect themselves from the spray of an opponent's water pistol. The barrier 50 may be permanently attached to the frame 10, or use any acceptable fastener known in the art, such as string, clips, zippers or hooks. Although canvas is preferred, other barrier materials are acceptable as long as those materials perform satisfactorily in the water fortress environment. The material requires structural integrity while remaining wet and materials such as plastic, nylon and cloth would be acceptable. The barrier 50 may partially or completely cover the base of the front section 60A, depending on the protection desired for the player within the water fortress 1.

FIG. 2 provides a side view of the water fortress 1. In addition to the front section 60A, frame 10 also includes a back section 60B. The frame 10 has a hinge point 61 which connects the front section 60A and back section 60B together. Line A—A shows the line of movement for opening and closing the front section 60A and the back section 60B by folding the frame 10 at the hinge point 61. When open, the hinge point 61 may have a locking mechanism (not shown) for securing the water fortress 1 in the open position.

The height of the front section 60A and back section 60B varies with the needs of the players. As such, the length may be changed with additional sections of the frame placed into the structure. Preferably, the back section 60B does not contain any water and no water flow exists between the front section 60A and the back section 60B. However, back section 60B may be designed for internal water flow, receiving water either from a garden hose or from the front section 60A.

As shown in FIG. 2, additional barrier 51 may be attached along the side of the water fortress 1. The additional barrier 51 is made from the same material as barrier 50, but is generally configured to be easily detachable. The additional barrier 51 is especially desirable when the game includes more than two players. FIG. 2 further shows the location of the water gun 33, the ball 41, the connection 42, the target 72 and the push valve 16 along the front section 60A which were previously discussed with reference to FIG. 1.

FIG. 3 illustrates a detailed side view of the component parts of the water reservoir 40 and target assembly 70. The target assembly 70 contains the target 72, a target rod 71, the trap door 75, the neck 73 and a trap door latch 74. The ball 41 is attached, such as threaded, to the neck 73 at the connection 42, and remains in water communication with the arch support 12 (cross sectionally shown). The neck 73 allows unobstructed water flow between the ball 41 and the target assembly 70. Once the part are connected, the push valve 16 is used to fill the ball 41. The design of the water fortress 1 places the target 72 close to the player and allows compressed air in ball 41 to in force water through the trap door 75 once it has opened.

During play, the target 72 is forced back when hit by water spray from an opponent's water gun. The target 72 forces the target rod 71 back, which forces the trap door latch 74 open, which preferably uses a single trip mechanism. The trap door 75 is rapidly forced opened by the pressure of the water above it. This releases the water from the target assembly 70 and water reservoir 40, through and out of the trap door 75. To reset, the trap door 75 is manually repositioned, and the trap door latch 74 is reconnected. The push valve 16 is used to flow water into the arch support 12, which refills the ball 41. Air within the ball 41 is unable to escape as the ball 41 fills, pressurizing the air in the ball 41 as it fills. Once the ball 41 is refilled, play is resumed.

FIG. 4 illustrates a front view of a second preferred embodiment of the water fortress 1, with additional targets 91 of the invention located along the lateral support 13. Once the target 91 is hit by an opponent's water gun spray, the target 91 falls back, and water is sprayed onto the player within the water fortress 1. The second preferred embodiment has the advantages of locating the target 91 alongside the player, which permits the targets 91 to be repositioned by an easy lifting motion.

FIG. 4 further illustrates a collapsible base section 110 of the front section 60A. The front section 60A may be collapsed by folding lock hinges 120. In this embodiment, the hose connection 20 is directly fixed to the lateral support 13 which is attached to a water hose 21. The collapsible base section 110 provides a easy assembly and disassembly of the water fortress 1 by providing elbows along the side of the frame 10. Collapsible base section 110 may alternatively be of a compressible spring along the diameter of the barrier area or a combination of the folding lock hinges 120 and compressible spring.

In either embodiment, the frame 10 may contain discharge points for water to be used by the players. A quick fill port 67 may be located on the frame 10 for filling hand water guns which are not connected to the frame 10. Further, additional water cut off switches (not shown) may be incorporated into the frame 10 to enhance water pressure build up.

Figure 5B:
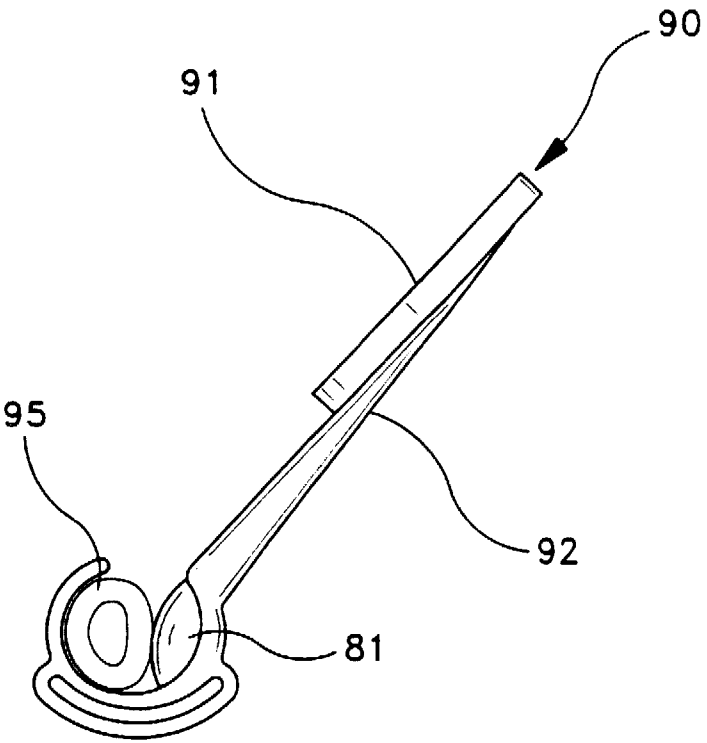
FIGS. 5A and 5B are exploded side views of the target assembly which is shown in FIG. 4.
Figure 5A:
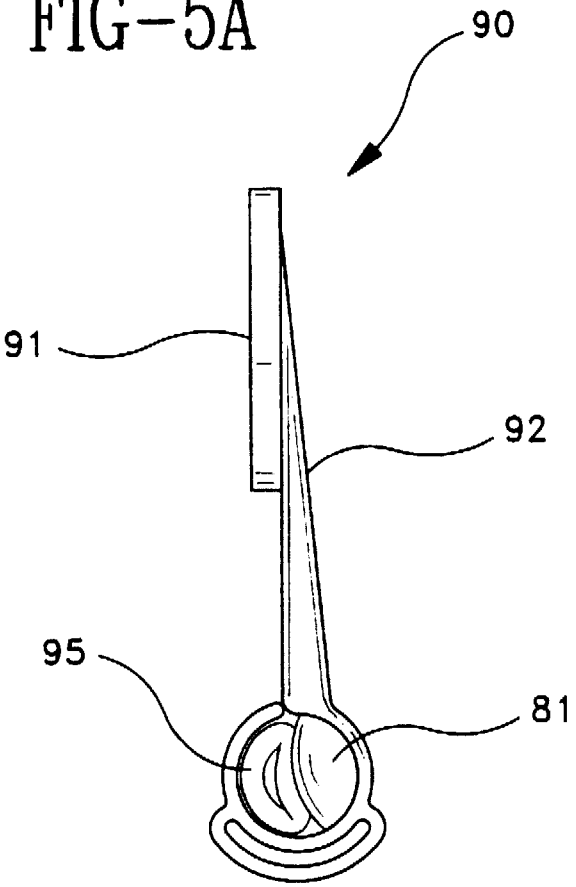

FIGS. 5A and 5B are illustrations of a target mechanism 90 of the targets 91 in FIG. 4. The target mechanism 90 contains a target stem 92, the target 91, and a projection 81.

The target mechanism 90 maintains a tube opening 95 in a closed position when the target mechanism 90 is in an upright position, by pressing the projection 81 against the tube opening 95. The tube opening 95 is charged with pressurized water from the frame 10. A latching mechanism, such as the target rod configuration of FIG. 1, may be used to release a locking mechanism holding the target mechanism 90 firmly against the tube opening 95. As the target 91 is contacted by water spray from an opponent, the target mechanism 90 is forced back, lifting the projection 81 from against the tube opening 95. As the target mechanism 90 is knocked down by an opposing player, the constricted tube 95 is allowed to open, spraying the player within the water fortress 1 with water. The water spray is stopped by resetting the target mechanism 90 or by interrupting the water supply using a cutoff switch within the lateral support 13.

EXAMPLE

Two players set up individual water fortresses approximately 20 feet apart.

Each water fortress is constructed by connecting individual parts of the front section frame together. The back section frame is then connected together. The front and back section frames are laid on the ground, and hinged together. While still on the ground, a water reservoir with a ball is attached onto the front section frame and a target assembly is attached. The hinged two sections are up-righted, with the base spread apart to support the standing frames. Material barriers are placed on the front of the water fortress. Gun hoses are attached to the lateral support, and water guns are attached to the gun hoses.

An unpressurized "Y" connection garden hose is connected to the front section frame at the hose connection of both water fortresses. The garden hose is pressurized with water. The players engage a push valve to flow water into the arch portion of the frame, while the trap door is open to purge the front section frame of any air. Once water flows through the trap door, the water is turned off, allowing the players to close the trap doors. Once the trap doors are closed, the water is turned on again, until the balls are filled in each water fortress.

Once the balls are full of water, play begins. The players shoot at the targets of the opposing player's water fortress. The targets are located within the fortress structure. Although the players direct their play at another player's target, the targets are located close to the players. This causes an opponent's water attack to become directed against the target, the fortress and the player within the fortress simultaneously. Water guns may have detachable connections to the water supply to permit a player to leave the fortress environment. Water guns also may be filled from a quick fill valve along the frame of the water fortress. By using quick release connections, water guns are easily changed through these detachable connections to the water supply, enabling a player to switch from a water pistol to a water rifle.

As each player directs water spray from a water pistol against an opponent's target, the target transmits the pressure of the water spray axially along a target rod which engages a trap door latch, pushing it to an open position. Once the trap door latch releases, water pressure from the ball rapidly forces the trap door open. The water falls from the ball and drenches the player standing within the water fortress. Afterwards, trap door is reattached, and the drenched player engages the push button pressurization valve, allowing the ball to refill with water from the frame. The game resumes until another hit opens a trap door.

The continuous water supply from the garden hose makes it easy to keep the water fortress clean throughout the period of play. It also allows the players to easily change positions during play. The continuous water supply further prevents any disruption in play, because the targets are re-energized by a simple repositioning of the target. Use of a garden hose make the water fortress convenient for individual players to use.

Once the game has ended, the water fortress is easy to store. The hollow plastic frame tubing is simple to disconnect and light-weight. Younger players are able to store the water fortress on their own without substantial adult assistance and/or guidance. Additionally, the water fortress is constructed of durable material which aids in storage. The canvas material may be folded for easy storage and movement. The water fortress could be constructed in sections of tubular parts, replacement of individual sections of the water fortress is done without the need to replace the whole frame. When not in use, a minimal amount of storage area is required for the entire water fortress. The small amount of storage area facilitates long term stowing of the water fortress, as the climate control in the storage space area is easier to maintain and individual parts of the water fortress are stored together and not lost. Additionally, there is no need to store the water fortress in high traffic areas, such as garages, lessening the wear and tear on the water fortress.

The foregoing summary, description, example and drawings of the invention are not intended to be limiting, but are only exemplary of the inventive features which are defined in the claims.

I claim:

1. A water fortress apparatus, comprising:

(a) a frame defining a space capable of retaining a player therein, the frame comprising hollow members which are capable of internal water flow, (b) a water connection in water communication with the hollow members, permitting pressurized water flow in and through the hollow members;

(c) a target mounted to the frame comprising means for releasing pressurized water from the frame when the target is activated;

(d) a water gun supply port capable of dispensing water from the hollow members; and, (e) a water gun detachably connected to the water gun supply port.

2. The water fortress according to claim 1, further having a shield attached to the frame and positioned between the hollow members.

3. The water fortress according to claim 1, further having a water reservoir in water communication with the hollow members.

4. The water fortress according to claim 3, wherein the reservoir further has a trap door allowing water release from the reservoir when the target is activated.

5. The water fortress according to claim 1, comprising a water gun permanently fixed to the frame.

6. The water fortress according to claim 1, wherein the frame has a front section comprising the hollow members and a back section which supports the front section in an upright position.

7. The water fortress according to claim 6, wherein the front and back sections of the frame are connected by folding lock hinges.

8. The water fortress according to claim 1, wherein the target comprises a constricting tube in water communication with the hollow members.

9. The water fortress according to claim 1, wherein the frame comprises plastic tubing.

10. The water fortress according to claim 6, wherein the front section comprises a compressible spring which enables the front section to be expanded to an open position.

11. The water fortress according to claim 6, wherein the front section comprises hinges, wherein the hinges are used to open and close an expandable part of the front section.

12. The water fortress according to claim 1, wherein the frame comprises detachable sections.

13. The water fortress according to claim 1, wherein the frame further comprises a hose in water communication with the hollow members for delivering pressurized water through the hose to the hollow members.

14. The water fortress according to claim 1, wherein the frame further comprises a valve for obstructing the water flow within the hollow members.

15. A water fortress array comprising a plurality of water fortresses, each water fortress comprising:

(a) a frame defining a space capable of retaining a player therein, the frame comprising hollow members which are capable of internal water flow, a water connection in water communication with the hollow members, permitting pressurized water flow in and through the hollow members; a target mounted to the frame comprising means for releasing pressurized water from the frame when the target is activated; a water gun supply port capable of dispensing water from the hollow members; and, a water gun detachably connected to the water gun supply port; and, (b) a water connection between each fortress and another fortress which allows water flow from the hollow members of one fortress to the hollow members of another fortress.

16. A method for playing a water fortress game, comprising:

(a) providing a water fortress comprising a frame defining a space capable of retaining a player therein, the frame comprising hollow members which are capable of internal water flow; a water connection in water communication with the hollow members, permitting pressurized water flow in and through the hollow members; a target mounted to the frame comprising means for releasing pressurized water from the frame when the target is activated; a water gun supply port capable of dispensing water from the hollow members; and a water gun detachably connected to the water gun supply port; and, (b) spraying the target with water from a water gun.

17. The method for playing a water fortress game according to claim 16, further including the step of:

releasing water from a reservoir through a trap door when the target is activated.

18. The method for playing a water fortress game according to claim 16, further including the step of:

releasing a constricted tube and thereby allowing water release through the tube when the target is activated by spraying water against the target.

19. The method for playing a water fortress game according to claim 16, including the steps of:

disconnecting the water gun from the water gun supply port; and then, filling the water gun from a quick fill port attached to the frame.

20. The method for playing a water fortress game according to claim 16, including the step of:

disconnecting the water gun from the water gun supply port; and then, connecting a different water gun to the water gun supply port.

* * * * *